United States Patent [19]

Schwebel

[11] 3,937,457

[45] Feb. 10, 1976

[54] SHEET FEEDER APPARATUS

[75] Inventor: Adolf Schwebel, Offenbach am Main, Germany

[73] Assignees: Mabeg Maschinenbau GmbH; Nachfolger Hense & Pleines GmbH & Co., both of Offenbach, Germany

[22] Filed: Aug. 19, 1974

[21] Appl. No.: 498,597

[30] Foreign Application Priority Data

May 14, 1974 Germany ..... 2423349

[52] U.S. Cl. ..... 271/92; 214/8.5 D

[51] Int. Cl.[2] ..... B65H 3/02

[58] Field of Search ..... 271/90, 91, 92, 93, 103, 271/104, 105, 106, 107, 108, 30 R, 31, 98; 214/8.5 D

[56] References Cited

UNITED STATES PATENTS

| | | | |
|---|---|---|---|
| 2,080,010 | 5/1937 | Rowlands et al. | 271/92 |
| 2,389,480 | 11/1945 | Baker | 271/92 X |
| 2,819,074 | 1/1958 | Williams | 271/92 |
| 2,869,867 | 1/1959 | Backhouse | 271/93 |

FOREIGN PATENTS OR APPLICATIONS

| | | | |
|---|---|---|---|
| 451,510 | 8/1936 | United Kingdom | 271/104 |

*Primary Examiner*—Evon C. Blunk
*Assistant Examiner*—Bruce H. Stoner, Jr.
*Attorney, Agent, or Firm*—W. G. Fasse; W. W. Roberts

[57] ABSTRACT

This sheet feeder apparatus is provided with pick-up heads for the sheets which heads are tiltable in at least one plane or in two planes automatically during the operation of the apparatus to properly align and/or stretch the sheets as they are picked-up from a stack and advanced for further handling. Thus, the pick-up heads are supported on support blocks and spring biased whereby the biasing forces tend to pull a sheet into proper alignment and/or to stretch a sheet without damaging the sheet.

14 Claims, 5 Drawing Figures

35
14
16
18
25
29
26
20
21
4
8
75
10
27
33
23
34
36
12
1
A 3
1
2
35
23
21
18
4
6'
7'
22
24
19
17
15
5
9
8
6
75
31
32
7
10
11
12
34
13
B
36
37

27
29
3
30
28
33
18
19
31
32
34
B

SHEET FEEDER APPARATUS

CROSS REFERENCE TO RELATED APPLICATION

My copending application Ser. No. 443,820, filed Feb. 19, 1974 also relates to a Sheet Feeder Apparatus.

BACKGROUND OF THE INVENTION

The invention relates to a sheet feeder apparatus and more specifically to the structural arrangement of the suction pick-up heads for such a sheet feeder apparatus which are employed for lifting a sheet, for example a sheet of paper, from a stack. The pick-up heads are supported for a tilting movement in at least one direction, preferably in two directions, namely in the direction of feed advance and/or in the direction extending perpendicularly to the direction of feed advance whereby the respective tilting axes are arranged at right angles relative to each other.

Conventionally, the suction pick-up heads were supported on a cross rod in a tilting manner so that the pick-up nozzles with a picked up sheet secured thereto would perform an upward stroke slanted in the forward direction. In this manner, the leading edge of a picked up sheet, which is supposed to be aligned with a respective stop rail, is moved through a substantially linear upward movement whereby the sheet is to be picked up precisely as a basis for its precise feeding and before it is taken up by the conveyor suction heads.

German Pat. No. 1,098,012 discloses a feeder arrangement in which the pick-up heads are supported on a cross bar by means of support blocks, the angular position of which is adjustable relative to the longitudinal extension of the cross bar. The adjustment of the angular position of the suction heads in this prior art disclosure is possible only when the machine is not operating, because clamping screws must be released prior to the adjustment whereupon the clamping screws must be tightened again. The adjustment in the stationary position is possible about different tilting points or axes, for example, to tilt the respective suction head in the feed advance direction and in a direction extending perpendicularly thereto. The adjustment in the reference is intended to assure the proper stretching of the sheet material, especially flexible sheet material, during the pick-up movement and to avoid interference between the sheet being lifted and the sensing blowing means which sense the height of the stack.

German Pat. No. 832,896 discloses a sheet lifter apparatus in which the motion of the pick-up heads is controlled by cam and cam follower means. At least one member of these cam and cam follower means is adjustable by hand, even during the operation of the machine. However, this adjustment is not one which takes place automatically and continuously in responds to the particular operating condition prevailing at any one instant.

East German Pat. No. 80,719 discloses an apparatus for the adjustment of the suction heads during the operation of the machine for the purpose of varying the position where the suction head contacts the top sheet of a stack. For example, if the sheets have a line of perforations, for instance along the margin, the adjustment of the suction head is to avoid that they contact the sheet in the area of the perforation. To this end both suctions heads are adjusted simultaneously.

The disadvantage of adjusting the angular position of the suction heads during the time when the machine is not operated is seen in that it causes substantial down times during which the machine is not productive. Besides, repeated adjustments may be necessary in order to achieve the desired position of the suction heads suitable for a particular working condition or type of sheet material. Besides, the change of the material, for example, as to thickness and sheet size and the material quality will require readjustments and respective further down times of the machine.

Even the adjustment of the position of the suction heads by hand during the operation of the machine is not entirely satisfactory, since it does not provide an automatic adjustment, so that readjustments will be necessary from time to time, especially where the type, quality and/or size of the sheet material to be handled has been changed.

OBJECTS OF THE INVENTION

In view of the above, it is the aim of the invention, to achieve the following objects, singly or in combination:

to support the suction pick-up heads in a sheet feeder apparatus in such a manner that their angular position relative to the feed advance direction and/or to a direction perpendicularly thereto is automatically adjustable during the operation of the machine without the need for an operator;

to provide means which will assure an automatic alignment of the sheets, even if any particular sheet should not be properly aligned on the stack;

to provide means which will automatically stretch a sheet during the operation of the machine and without any action on the part of the operator; and to support the suction pick-up heads in such a manner that they will adjust their position individually but in unison and simultaneously in order to timely feed or pick-up a sheet and to align its leading edge in parallel to any alignment markers of the apparatus, so that the pick-up heads will follow a curved movement during the separation or lifting of a sheet whereby such curved movement may even resemble a slanted curve and whereby the continuous adjustment may take place automatically in the feed advance direction or longitudinally and/or in a direction perpendicularly to the feed advance direction.

SUMMARY OF THE INVENTION

According to the invention there is provided a suction head for a sheet feeder apparatus for separating or lifting of a sheet from a stack, wherein the lifting or pick-up suction heads are controlled in their movement by a cross bar. The suction heads are adjustable in the feed advance direction or rather in a plane extending in the feed advance direction and substantially vertically as well as in a direction perpendicularly to the feed advance direction or rather in a plane extending substantially vertically and perpendicularly to the feed advance direction, whereby the respective tilting axes extend at right angles to each other. For this purpose, the invention provides a tilting support block for each suction pick-up head. The support blocks are tiltably secured to a frame structure, whereby in one embodiment each support block provides two tilting axes extending at right angles to each other. Each suction head has a downwardly facing end to which the suction nozzle is secured and an upwardly facing end to which one end of an adjusting rod is secured. Said tilting axes are located intermediate the ends of the respective suction head. The opposite end of the adjusting rod extends through guide means secured to the frame structure or housing and is provided with a thread on which a knurled nut or screw is rotatable to bear against a fixed point, for example said guide means for the adjusting rod. Compression spring means are located between the upper end of the suction head and the guide means so as to urge these two elements away from each other. The length of the adjusting rod and thus the bias of the respective compression spring means may be adjusted by rotation of the respective nut. The position of the adjusting rod may be itself adjusted by a respective adjustment screw against the force of a compression spring so that again the bias of that spring is adjustable. Thus, the longitudinal adjustment of the length of the adjusting rod will control the automatic yielding and thus adjustment of the suction head in the feed advance direction and the adjustment of the position of the adjusting rod will control the automatic adjustment of the respective suction head in the direction extending perpendicularly to the feed advance direction. According to another embodiment of the invention, the support means are arranged in such a manner that one pick-up or suction head is adjustable in the direction of the feed advance whereas the other suction head is adjustable in a direction extending perpendicularly to the feed advance direction. The adjustment in the feed advance direction may be accomplished automatically against the force of adjustable bias springs as in the above embodiment. The adjustment in the direction perpendicularly to the feed advance direction is accomplished by a piston cylinder arrangement connected to a suction pump. The piston is exposed to the atmosphere with its outwardly facing surface which is connected through tension spring means to the upper end of the pick-up head. A lower tension spring connects the respective pick-up head to a fixed point below the tilting axis. The lower tension spring tends to hold the pick-up head in the vertical position. Suction is applied to the cylinder through a control valve mechanism which is operated by the main drive shaft of the apparatus, whereby the application and removal of suction is synchronized with the operation of the machine. The stiffness of the upper tension spring is such that it will yield in response to the proper stretching of a sheet whereby damage to the sheet is avoided and the spring will yield to the extend necessary for the piston to complete its stroke.

BRIEF FIGURE DESCRIPTION

In order that the invention may be clearly understood, it will now be described, with reference to the accompanying drawings, wherein.

DETAILED DESCRIPTION OF EXAMPLE EMBODIMENTS

Figure 1:
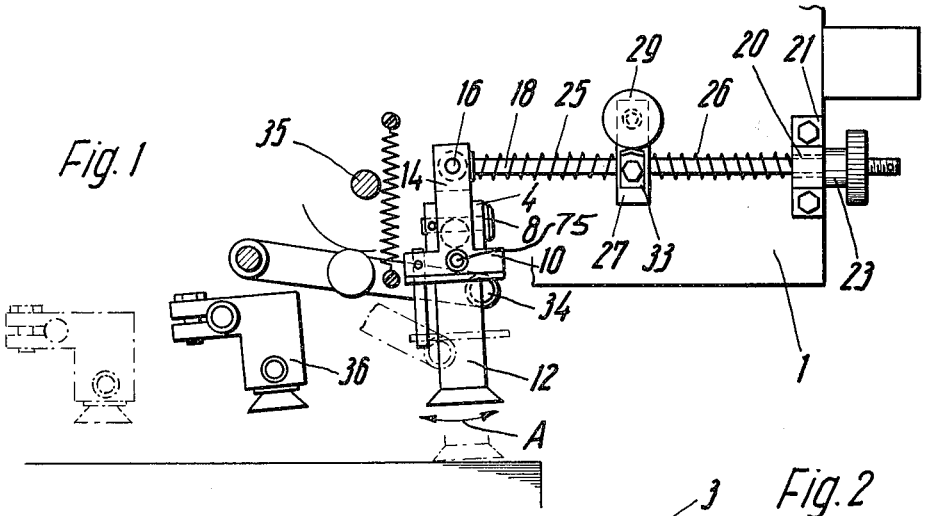
FIG. 1 is a somewhat schematic side view of one embodiment of the apparatus according to the invention and showing especially the means for an adjustment of the suction heads in the feed advance direction as well as in a direction extending perpendicularly to the feed advance direction.
Figure 2:
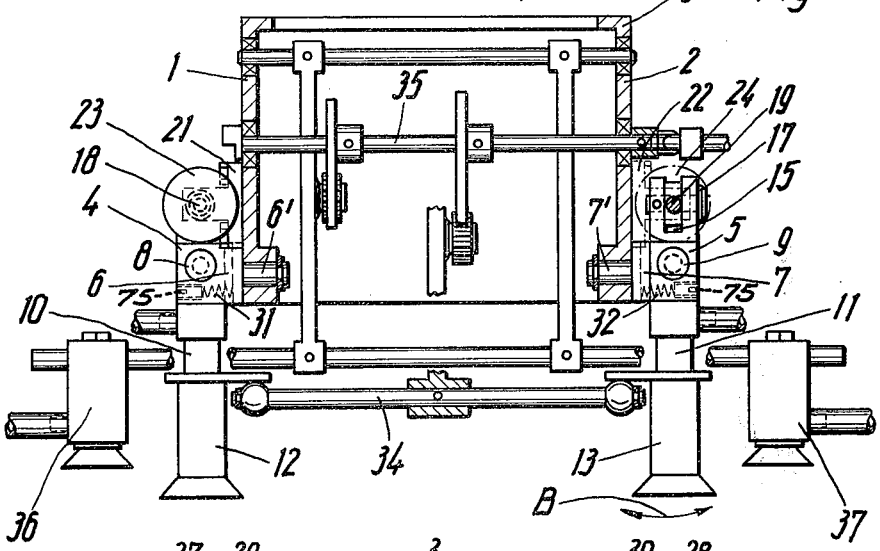
FIG. 2 is a front view partially in section through the apparatus illustrated in FIG. 1.

Referring first to FIGS. 1 and 2, there is shown a frame structure or housing 3 having side walls 1 and 2. Support blocks 4 and 5 are tiltably secured to the respective side walls 1 and 2. The bearing blocks 4 and 5 are secured, for example, by tongue and groove means 6 and 7 to sleeve bearings 6' and 7' whereby a tilting movement in the feed advance direction, as indicated by the double arrow A, is possible.

Further, each suction head 10 and 11 is secured to its respective bearing or support block for tilting about a holding pin 8 or 9. Thus, the suction heads are also tiltable in a direction extending perpendicularly to the feed advance direction or rather in a plane extending perpendicularly to the feed advance direction as shown by the double arrow B.

The upper end of each suction head 10, 11, forms a fork 14, 15 in which is movably secured one end of a respective adjusting rod 18 and 19, for example, by means of bolts 16 and 17. The adjusting rods 18 and 19 extend substantially longitudinally along the respective side walls 1 and 2 of the suction head housing or frame structure whereby the free end of each adjusting rod extends through an aperture 20 of a guide piece 21, 22, preferably secured to the respective side wall of the housing. The guide rod extends with a substantial tolerance and thus freely through the respective guide piece 21 or 22 and is provided at its outer free end with a threading on which there is screwed a knurdled adjusting screw or nut 23, 24 bearing against the housing or against the guide piece 21, 22. Adjustment of the nut 23, 24 will tilt the respective suction head 10, 11 in the direction of the arrow A. Compression spring means 25, 26 are arranged on the respective adjustment rod 18 or 19 to urge the upper end of the fork 14 and thus of the respective suction head away from the guide piece 21, 22. During the operation of the machine, the spring means will constantly urge the respective suction head to tilt in the feed advance direction. For providing a tilting adjustment in the direction B across the feed advance direction, lever members 17, 28 are arranged intermediate the ends of the adjustment rods 18, 19 whereby these rods extend through respective holes in the lever members 27, 28. The lever members bear with their lower end against the respective side wall of the housing and the upper free end of each lever member is provided with a threaded hole through which an adjustment screw 29, 30 extends which also bears against the side wall. The adjustment of these screws, preferably also knurled screws 29, 30 is effective against the force of respective compression springs 31, 32 arranged in the corresponding suction head and bearing against the opposite housing wall or rather against the portion of the corresponding support block secured to the housing wall. Set screws 75 may be provided in the pick-up heads for adjusting the bias of the compression springs 31, 32.

Figure 3:
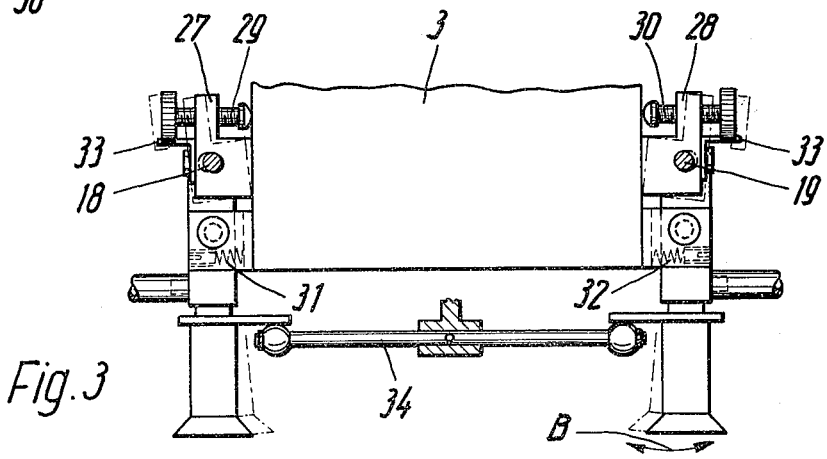
FIG. 3 is also a view in the same direction as in FIG. 2 however, showing the details of the adjusting means for an adjustment in the direction extending perpendicularly to the feed advance direction.

As shown in FIG. 3, adjustment of the screws 29 and 30 lightly shifts the corresponding lever members 27, 28 and thus also the corresponding adjustment rods 18, 19 and with these rods the suction heads 10, 11 with their respective pick-up nozzle 12 and 13 to move into the dashed dotted position shown in FIG. 3. Preferably, locking means are provided in the form of springs 33 which cooperate with the grooves in the knurled circumference of the screws 29, 30. The springs are secured to the corresponding lever members 27, 28.

In order to assure that the suction heads 10, 11 will lift or pick-up the sheets without any trouble, the extent of the tilting motion in both directions is limited. For example, by means of respective stops.

The cross rod 34 raises the nozzles 12, 13 in response to the rotation of the drive shaft 35, actuating the cross rod 34 by means of appropriate cam and cam followers, as described in more detail in my above mentioned copending application, whereby simultaneously controlled suction air is applied to these suction nozzles 12, 13. As soon as the lifting operation by the nozzles 12, 13 is accomplished, the sheet is taken up by the advance suction heads 36, 37 for transport in the feed advance direction, for example to feed these sheets into a printing press or into any other sheet handling apparatus.

Figure 4:
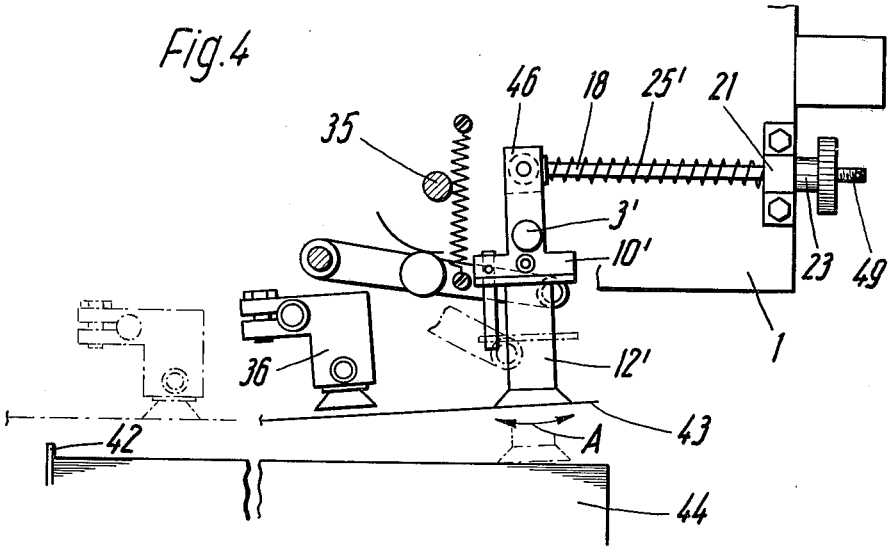
FIG. 4 is a view similar to that of FIG. 1, however, omitting the cross adjustment means.
Figure 5:
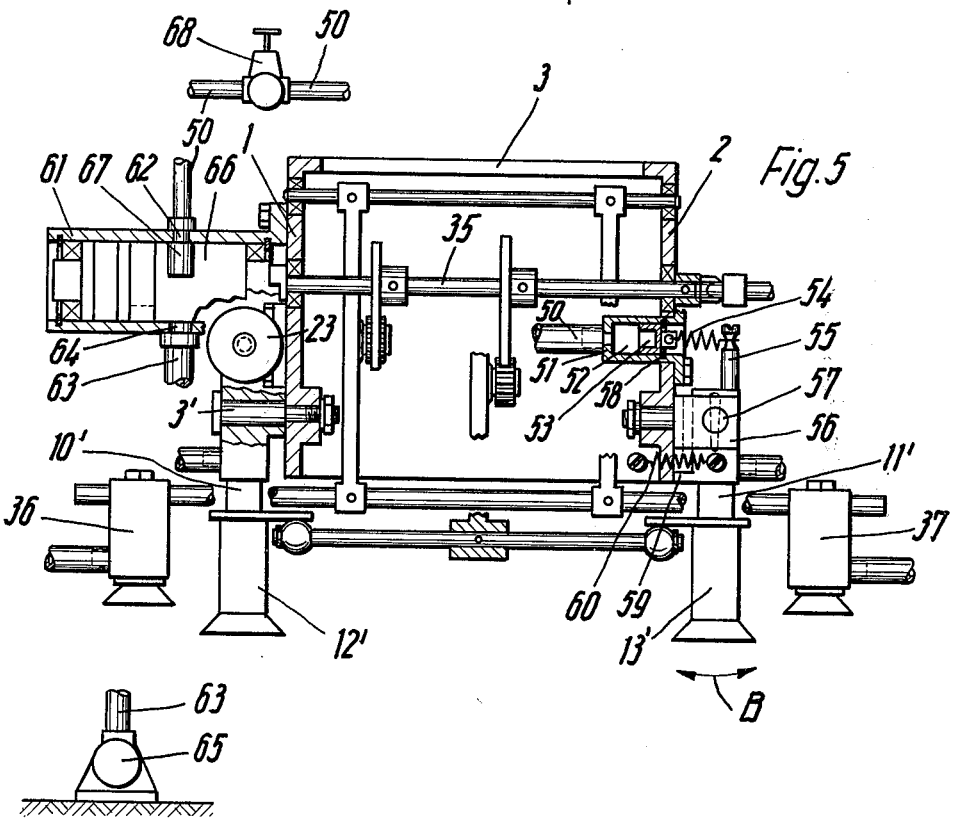
FIG. 5 is a view similar to that of FIG. 2, however, illustrating a different embodiment for the automatic adjustment of the right hand suction head in a direction extending across the feed advance direction and for the adjustment of the left hand suction head in the feed advance direction.

FIGS. 4 and 5 illustrate an embodiment wherein one suction head 10′ is adjustable only in the feed advance direction A and wherein the other suction head 11′ is adjustable only in the direction B extending across the feed advance direction. For this purpose, the support member of the suction head 10′ is a tilting axis 3′ secured to the side wall 1 of the housing 3. The upper or free end 46 of the suction head 10′ is forked and connected to an adjustment rod 18 which extends substantially horizontally along the respective side wall 1 and with its opposite end with substantial tolerance and thus freely through a guide piece 21. The outer end of the adjusting rod 18 is provided with threads 49 carrying an adjusting nut 23 substantially as described above with reference to FIG. 1 except that in FIG. 4 the means for the cross adjustment are omitted. A spring 25′ on the rod 18 urges the head 10′ away from the guide piece 21 and thus the nut 23 against the guide piece 21. This type of construction with the compression spring 25′ assures that sheets 43, one edge of which is not precisely aligned with the stop rail 42, will nevertheless be precisely straightened out during the pick-up movement of the corresponding pick-up head. Thus, even if the sheets on the stack 44 are out of alignment with the stop rail 42, they will be properly aligned by the lifting movement as taught by the present invention.

Referring especially to FIG. 5, the suction head 11′ is supported for an automatic tilting movement in the direction B extending across the feed advance direction. For this purpose, a support block 56 is rigidly secured to the side wall 2. A tilting bolt 57 forming the tilting axis for the suction head 11′ secures the suction head 11′ to the support block 56 for the tilting movement in the direction B, whereby the pick-up nozzle 13′ is also tiltable in that direction along with its head. A cylinder 51 is secured to the side wall 2 above the head 11′. The inner end of the cylinder 51 is connected through a hose 50 to a suction pump 65 by means of a control valve 61 having a valve plug 66 which is rotated by the main drive shaft 35 of the apparatus.

A piston 53 is arranged in the space 52 of the cylinder 51. The cylinder 51 has an open end facing outwardly relative to the wall 2 so that the respective surface of the piston 53 is exposed to the atmosphere. The piston 53 is connected to the upper end of the suction head 11′ by means of a spring 54 preferably secured to an arm 55 extending upwardly from the suction head 11′ above its pivot axis 57. The operation of the spring 54 is such that the suction head 11′ will take up a substantially vertical position when no suction is applied to the cylinder 51 whereby the piston 53 rests against a ring 58 so to speak in its starting position. To this end, there is also provided a further spring 60 connecting the suction head 11′ below its tilting axis 57 to a fixed point, for example, in the housing 3 whereby a stop member 59 limits the inward pull of the tension spring 60 to hold the suction head 11′ in said vertical position when it is in its rest position.

The upper tension spring 54 is dimensioned with due regard to the control of the entire system in such a manner that it will yield only after a lifted sheet 43 has been stretched to the desirable extent. The extent to which the tension spring 54 will yield after sufficient stretching has been accomplished is such that the piston 53 may complete its stroke. This feature according to the invention assures that independently of the nature of the sheet material being handled, a constant stretching of the sheet material is accomplished whereby the stetching force is automatically controlled by the limited stiffness of the spring 54 without overstretching a sheet 43 whereby wrinkling and damage to the sheet is avoided.

The control valve 61 is secured to the side wall 1 of the housing and the conduit hose 50 connects the cylinder 51 to the port 62 of the control valve 61. A pump 65 continuously applies suction to the control valve through the conduit 63 connected to the port 64 of the control valve 61. A control plug 66 is rotatably supported in the control valve 61 and rotated by the main drive shaft 35 of the sheet feeder apparatus. The plug 66 has a control groove 67 which successively admits suction to the cylinder 51 in synchronism with the operation of the apparatus due to the drive by such shaft 35. Thus, the suction is applied to the cylinder 51 each time when the suction nozzles 12′, 13′ have picked up a sheet 43 from the stack 44 whereby the piston 53 moves to the left and the suction nozzle tilts outwardly or to the right as viewed in FIG. 5 to thereby stretch the picked up sheet to the extend permitted by the force of the tension spring 60.

The application of suction to the cylinder 51 by the control groove 67 in the valve plug 66 is interrupted as the plug 66 rotates to cause the return of the suction head 11′ into its starting position after the sheet 43 has been taken over by the feed advance suction heads 36, 37. Simultaneously, the pick-up nozzles 12′, 13′ jump down onto the stack 44 to pickup a new sheet.

A limit valve 68 is preferably arranged in the conduit hose of pipe 50 in order to adjust or control the intensity of the suction air applied to the cylinder 51. If desired, the regulating valve 68 may also be secured to the housing of the control valve 61.

Although the invention has been described with reference to specific example embodiments, it is to be understood, that it is intended to cover all modifications and equivalents within the scope of the appended claims.

What is claimed is:

1. In a sheet feeder apparatus for transferring sheets in a transport direction, said feeder apparatus having a frame structure, sheet pick-up means including at least one pick-up head, means for adjustably securing said sheet pick-up means to said frame structure, and adjusting means operatively connected to said adjustable securing means, the improvement wherein said adjustable securing means comprise a support block, first means pivoting said support block to said frame structure for rotation about a first fixed horizontal axis extending transversely of the transport direction, further means pivoting said pick-up head intermediate its ends to said support block for rotation about a second axis extending in a plane normal to said first axis, said adjusting means comprising an adjusting rod having a threaded end and an opposite end, said opposite end being secured to an upper end of said pick-up head, guide means secured to said frame structure, said adjusting rod extending through said guide means with said threaded end extending out of said guide means, an adjusting nut on said threaded end of said adjusting rod, and spring means on said adjusting rod urging said upper end of said pick-up head away from said guide means and thus the adjusting nut against the guide means.

2. The apparatus according to claim 1, wherein said support block with said first pivoting means is tiltable in a first plane extending substantially vertically in said transport direction, whereby rotation of said adjusting nut tilts said support block in said first plane, said support block and said further means being pivotable in a second plane extending substantially vertically and perpendicularly to said transport direction, said adjusting rod means extending with play through said guide means, said adjusting means further comprising a lever member having a hole intermediate its ends, said adjusting rod extending through said hole in the lever member, said lever member having a first free end bearing against said frame structure and a second free end with a threaded hole through said second free end, and an adjusting screw extending through said threaded hole and bearing against the frame structure whereby rotation of said adjusting screw shifts the position of said adjusting rod to thereby tilt said pick-up head in said second plane.

3. The apparatus according to claim 2, wherein said adjusting screw comprises a knurled head with grooves in its circumference, and spring means secured against rotation and engaging said grooves to lock said adjusting screw against undesired rotation.

4. The apparatus according to claim 2, wherein the length of said threaded end of the adjusting rod is limited to limit the tilting adjustment in said first plane, and wherein said adjusting screw has a threading of limited length to limit the tilting adjustment in said second plane.

5. The apparatus according to claim 2, further comprising compression spring means located in said pick-up head below said further pivot means and bearing against said frame structure to bias said pick-up head against the adjustment of said adjusting screw.

6. The apparatus according to claim 5, further comprising a set screw in said pick-up head for adjusting the bias of said compression spring means.

7. The apparatus according to claim 6, comprising an integral structural unit including said support block with its pivotable means, said compression spring means and the set screw, said pick-up head, said adjusting rod with its guide means and its adjusting nut, said spring means and said lever member with its adjusting screw, said apparatus further comprising means for mounting said structural unit to said frame structure.

8. In a sheet feeder apparatus for transferring sheets in a transport direction, said sheet feeder apparatus having a frame structure, sheet pick-up means including first and second pick-up heads, first and second means for adjustably securing said first and second sheet pick-up means respectively to said frame structure, and first and second adjusting means operatively connected to said first and second adjustable securing means respectively; the improvement wherein said first adjustable means comprises a first support block, first means pivoting said first support block to said frame structure for rotation about a first fixed horizontal axis, means affixing said first pick-up head to said first support block, said first adjusting means comprising an adjusting rod having one end secured to said first pick-up head, and means for moving said adjusting rod to tilt said first pick-up head about said first axis in a first plane extending substantially vertically and in said transport direction, said second adjustable securing means comprising a second support block, means mounting said second support block on said frame structure, means pivoting said second pick-up head intermediate its ends to said second support block for rotation about a second axis, whereby said second pick-up head is tiltable in a second plane extending substantially vertically and perpendicularly to said transport direction, and said second adjusting means comprising control means operatively coupled to said second pick-up head for tilting said second pick-up head in said second plane.

9. The apparatus according to claim 8, wherein said first support block and said second support block prevent tilting of the corresponding pick-up head in the respective opposite direction.

10. The apparatus according to claim 8, wherein said control means comprise a cylinder secured to said frame structure above said second support block, a piston in said cylinder, first tension spring means, and means connecting said first tension spring means to said piston and to the second pick-up head above its tilting axis, suction pump means, conduit means connecting said cylinder to said pump means, said piston having a surface exposed to the atmosphere, said conduit means including control valve means for sequentially applying suction to said cylinder synchronously with the picking-up of a sheet by said pick-up heads, and further spring means connecting said second pick-up head below its tilting axis to said frame structure to pull the second pick-up head toward the frame structure against the force of said first tension spring means, whereby the second pick-up head is held in a substantially vertical rest position.

11. The apparatus according to claim 10, wherein said control valve means comprise a housing and a valve plug therein which opens the conduit means for the application of suction to said cylinder synchronously with the picking-up of a sheet by said pick-up heads whereby the second pick-up head is tilted about its tilting axis in said second plane out of the vertical rest position.

12. The apparatus according to claim 10, further comprising a stop member, said further tension spring means pulling said second pick-up head against said stop member.

13. The apparatus according to claim 10, wherein said first spring means comprises a stiffness just sufficient to properly stretch a picked-up sheet, said first spring means yielding just sufficiently to permit the completion of the stroke of the respective piston after the completion of the stretching of a picked-up sheet.

14. The apparatus according to claim 10, wherein a suction intensity control valve is arranged in said conduit means.

* * * * *